US007226961B2

(12) United States Patent
Park et al.

(10) Patent No.: US 7,226,961 B2
(45) Date of Patent: Jun. 5, 2007

(54) THERMOCHROMIC GOLF BALL

(75) Inventors: Yang Hwan Park, Seoul (KR); Kyung Jung Kang, Kyoenggi-do (KR); Gwang Hee Lee, Kyoenggi-do (KR); Jung Gyu Moon, Tigard, OR (US); Chun Bae Ryu, Seoul (KR)

(73) Assignee: Fantom Company, Ltd., Seoul (KR)

( * ) Notice: Subject to any disclaimer, the term of this patent is extended or adjusted under 35 U.S.C. 154(b) by 30 days.

(21) Appl. No.: 10/838,387

(22) Filed: May 4, 2004

(65) Prior Publication Data

US 2004/0266555 A1 Dec. 30, 2004

(30) Foreign Application Priority Data

Jun. 27, 2003 (KR) ..... 10-2003-0042816

(51) Int. Cl.
*A63B 37/00* (2006.01)

(52) U.S. Cl. ..... 523/205; 473/351; 473/378; 428/402.2; 428/402.21; 428/402.24; 8/552; 8/566; 8/657

(58) Field of Classification Search ..... None
See application file for complete search history.

(56) References Cited

U.S. PATENT DOCUMENTS 4,028,118 A * 6/1977 Nakasuji et al. ..... 106/31.19
5,461,109 A * 10/1995 Blair et al. ..... 524/839
5,527,385 A * 6/1996 Sumii et al. ..... 106/31.17
5,989,135 A 11/1999 Welch
6,037,419 A 3/2000 Takesue et al.
6,130,294 A 10/2000 Ichikawa et al.
6,755,912 B2 * 6/2004 Brown et al. ..... 118/500
2003/0109329 A1 * 6/2003 Kennedy, III ..... 473/351
2005/0014578 A1 * 1/2005 Kennedy, III ..... 473/378

FOREIGN PATENT DOCUMENTS

JP 11076463 * 3/1999

OTHER PUBLICATIONS

Camel Chemical, Website Publication, 6 pages, Dec. 29, 2003.

* cited by examiner

*Primary Examiner*—David J. Buttner
(74) *Attorney, Agent, or Firm*—J. Bennett Mullinax, LLC

(57) ABSTRACT

Disclosed is a thermochromic golf ball with a one- or multi-piece structure, which comprises a thermochromic compound. The thermochromic golf ball reversibly changes between two different color states with temperature. The thermochromic golf ball may be white when it is warmed to higher than a thermochromic temperature point, but shows a characteristic color when it is cooled to lower than the point. In a two-piece or three-piece ball, the thermochromic compound is present in either the outer cover or a transparent coat applied to the cover. The thermochromic pigment changes color when a critical point temperature is reached, thereby alerting the golfer that the current temperature of the golf ball may have power performance characteristics.

10 Claims, 2 Drawing Sheets

THERMOCHROMIC GOLF BALL

PRIORITY APPLICATION

This application claims the benefit of the Republic of Korea application having serial number 10-2003-0042805 filed on Jun. 27, 2003, and which is incorporated herein by reference.

BACKGROUND OF THE INVENTION

1. Field of the Invention

The present invention relates to a thermochromic golf ball whose color reversibly changes with temperature. More particularly, the present invention relates to a thermochromic golf ball which shows one color when it is at a temperature greater than a critical temperature point and appears in yet another color when it is below the critical temperature point. The critical point temperature is a temperature point where performance of a golf ball may be impaired.

2. Description of the Prior Art

In golf, it is often advantageous to drive a golf ball as far as possible on tee shots. Frequently, golfers will purchase balls, clubs, or other equipment which purport to bring about greater distance drives and shots. In the highly competitive golf arena, golfers continually search for advantages in equipment selection to help achieve greater flight distance and total carry distance of their golf shots. However, it is very difficult for golfers to extend their drive distances.

There are numerous factors which may influence a golf ball's flight distance. These factors include golf club and ball performance, weather, and golf course layout as well as the player's various abilities. One component of weather, namely ambient temperature, may exert a significant influence on a ball's flight distance. At a low temperature (about 10° C. for example), a golf ball's resiliency is impaired and has a negative impact on flight distance. Accordingly, during cold weather play, a player's drive distance may be lessened if a cold golf ball is used.

The desired performance of a golf ball can be maintained if the golf ball is kept at a temperature of about 20° C. or higher. With the knowledge of the golf ball's temperature, a golfer can maintain his average drive distances even in the winter. For instance, if a golf ball having a temperature lower than 20° C. can be warmed to 20° C. or higher by the player's body temperature or by means of a heater, the player can play the ball with confidence that the optimal drive distance will not be affected due to cold weather.

SUMMARY OF THE INVENTION

It is an object of at least one of the present embodiments of the invention to provide a thermochromic golf ball which reversibly changes color as the temperature of the ball changes.

It is another object of at least one of the present embodiments of the invention to provide a thermochromic golf ball which assists golfers' play in cold weather.

In at least one embodiment of the present invention, the golf ball comprises a thermochromic material of a heat-sensitive dye and a surrounding encapsulation material which encapsulates the heat-sensitive dye and facilitates the dispersal of the thermochromic material.

In another aspect of at least one embodiment of the present invention, the thermochromic golf ball has a two-piece structure consisting of a core, a cover provided with a number of dimples thereon enclosing the core, and one or more transparent top coats applied to the cover, the thermochromic material being contained either the cover or one of the transparent top coats which may include a transparent primer layer positioned between the cover and the outermost clear top coat layer.

In an additional aspect of at least one embodiment of the present invention, a thermochromic golf ball is provided which has a three-piece structure consisting of a core, an inner cover enclosing the core, an outer cover provided with a number of dimples, and a transparent coat on the outer cover, with the thermochromic compound contained in either the outer cover or one of the transparent coats such as a clear primer coat or a polyurethane clear top coat.

The above objects may be accomplished by a thermochromic golf ball which reversibly changes color in response to temperature changes.

These and other features, aspects, and advantages of the present invention will become better understood with reference to the following description and appended claims.

BRIEF DESCRIPTION OF THE DRAWINGS

A fully and enabling disclosure of the present invention, including the best mode thereof to one of ordinary skill in the art, is set forth more particularly in the remainder of the specification, including reference to the accompanying drawings.

DETAILED DESCRIPTION OF THE PREFERRED EMBODIMENT

Figure 1:
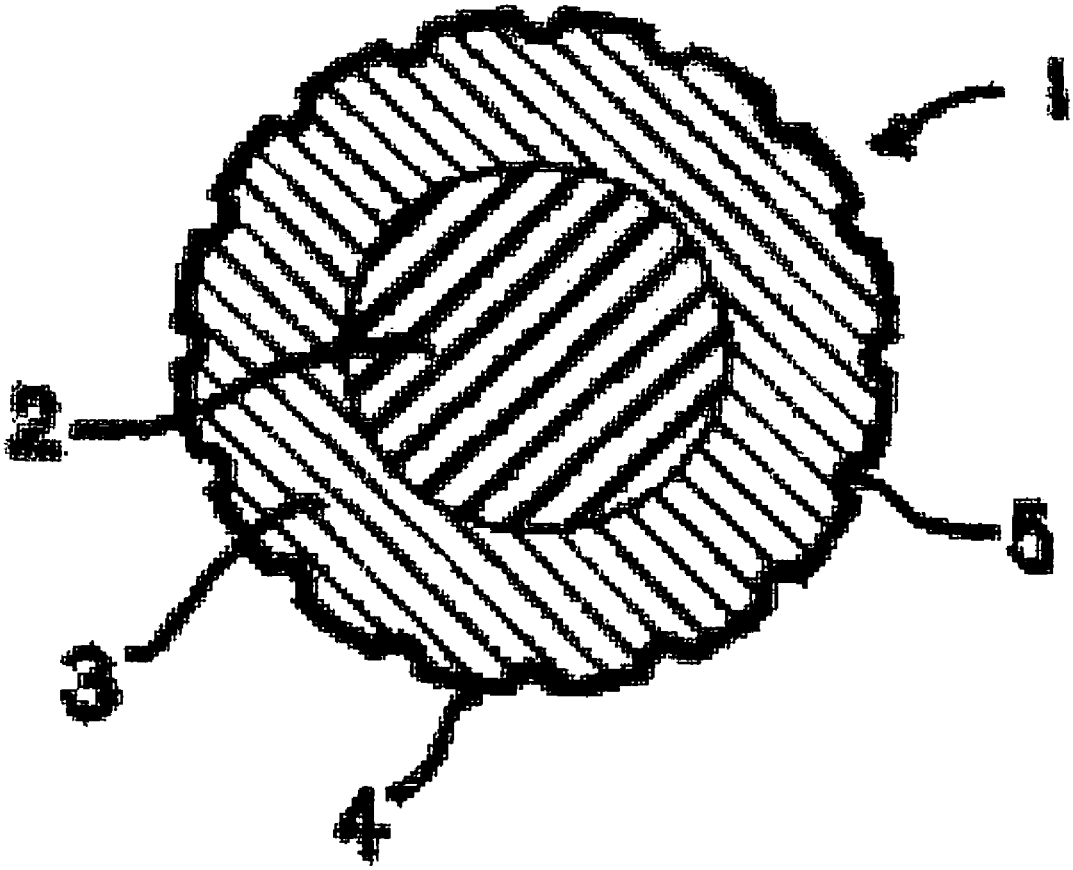
FIG. 1 is a cross-sectional view showing the structure of a two-piece golf ball according to an embodiment of the present invention.

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus or process pathway. To avoid redundancy, detailed descriptions of much of the apparatus once described in relation to a figure is not repeated in the descriptions of subsequent figures, although such apparatus or process is labeled with the same reference numbers.

The present invention is directed to an improvement in golf balls by use of thermochromism. The golf ball of the present invention may appear in two or more different colors depending upon the temperature of the ball. For example, the golf ball has a first color at a temperature higher than 20° C. and another different color at a temperature lower than 20° C. That is, the golf ball reversibly changes its surface colors with 20° C. as the thermochromic point.

In the present invention, the golf ball can be prepared by the inclusion of a thermochromic compound into either the outer cover and/or one or more of the finish coat(s) of the golf ball. The thermochromic compound may be homogeneously mixed with a synthetic resin and the mixture may be molded into a cover for golf balls by injection molding. Alternatively, the thermochromic compound may be homogeneously mixed with a transparent coating such as a clear primer or a polyurethane clear top coat applied to the surface of the golf ball.

The golf ball according to the present invention may have a one-piece structure or a multi-piece structure. For example, the golf ball of the present invention may be a 2-piece ball, a 3-piece ball, or a higher multi-piece ball. In such typical golf ball structures, the thermochromic compound may be contained in a cover layer for 2-piece golf balls, in an outer cover layer for 3-piece golf balls, or in a transparent coating paint for all kinds of pieces. For example, the thermochromic golf ball of the present invention may be a 2-piece structure consisting of a core, a cover layer with dimples, and a transparent coat on the cover layer, where a thermochromic compound is contained in the cover and/or the transparent coat.

Any compound, if it can change its color according to temperature and is compatible with the ball cover or paint chemistry, may be used in the present invention. A thermochromic compound is a compound which shows a reversible color change (including a change in color shade) which occurs at a critical temperature point. The color change may occur gradually over a temperature range or occur more suddenly in association with a critical temperature point. A large number of organic, inorganic and macromolecular compounds are known to be thermochromic.

Thermochromic compounds found useful in the present embodiment of the invention are heat-sensitive microcapsules consisting of a heat-sensitive dye with a wax dispersant and which is surrounded by an encapsulation wall material. The thermochromic dye shows characteristic colors at temperatures lower than a critical point. Thermochromic dyes useful in the present invention are not limited to the specific compounds discussed herein but includes other thermochromic pigments and dyes which are compatible with the golf ball cover ionomers and molding process and/or compatible with incorporating into a clear, polyurethane top coat finish for a golf ball.

The thermochromic compounds which have been found useful in terms of application for typical golf ball constructions are as follows. Thermochromic dye, dibutylamino-6-methyl-7-anilinofluoran (CAS NO.: 89331-94-2, hereinafter referred to as "thermochromic dye I") with a characteristic black color; 3,3-diethylamino-7-chlorofluoroan (CAS NO.: 26567-23-7, hereinafter referred to as "thermochromic dye II") with a characteristic red color; crystal violet lactone (CAS NO.: 1552-42-7, hereinafter referred to as "thermochromic dye II") with a blue characteristic color; or 3-cyclohexyl amino-6-chlorofluoran (CAS NO.: 26206-78-0, hereinafter referred to as "thermochromic dye IV") with a characteristic orange color may be used. The wax dispersant is selected from the group consisting of myristyl alcohol (CAS NO.: 112-72-1), cetyl alcohol (CAS NO.: 36653-82-4), stearyl alcohol (CAS NO.: 112-92-5) and mixtures thereof. Melamine (CAS NO.: 108-78-1) is useful as the wall encapsulation material. The thermochromic compound materials identified above, along with other colors and shades of thermochromic materials, can be purchased in either a powder form or as a microencapsulated slurry form from Camel Chemical, Pusan, Korea.

The thermochromic compounds referenced above may be obtained as a pre-packaged additive having a wide number of temperature transition points. For use for incorporation into an ionomer cover, the thermochromic pigment can be supplied in a powder form having a particle size of about 20 μm to about 40 μm. For use in a polyurethane paint top coat, the thermochromic dye is available as a pre-packaged slurry which has been found to incorporate well into a top coat composition.

While the present invention is disclosed with respect to some specific embodiments set forth below, the thermochromatic pigment may be applied in at least three different manners. For instance, the pigment may be mixed in with the cover materials so that the cover will undergo the desired color change. When the color change pigment is in the cover, a clear primer coat should be applied to the cover such as conventional water based non-pigmented primers. Following drying, any markings or pad printing which is desired can be done on the primer coated surface followed by coating the primer surface with a clear top coat. Alternatively, any markings or pad printing may be applied directly to the cover along with one or more transparent coatings applied thereto. Typically, a clear top coat is a solvent based polyurethane coating which, in the present example, would not contain any additional pigments.

Optionally, a cover can be provided having conventional titanium dioxide or other white pigments present. Thereafter, the cover can be coated with a clear primer coat which includes the indicated color change pigment. Following drying, any pad printing can be done on the dried primer coat which is then followed by a clear top coat. In this manner, the top coat helps protect the color change pigment present in the primer coat and does not mask or obscure the color change properties of the resulting golf ball.

Yet an additional option is to provide for a typical pigmented cover for the golf ball and then coating with a primer coat which may include additional white pigments. Thereafter, the cover is pad printed with any markings that are desired and a clear top coat which includes an effective amount of the color change pigment is then applied. In this manner, a golf ball having a conventional white coloration may be provided in which the ball undergoes a color change under the appropriate environmental stimulus.

The thermochromic pigments are available in at least 13 different temperature change points ranging from about 0° C. to about 52° C. including temperature change points of 5, 10, 15, 20, and 25° C. While the examples set forth below use materials which were selected for a color change point of about 10° C., it is readily appreciated by one having ordinary skill in the art that a higher or lower temperature change point may be selected. Further, it is envisioned that two different pigment colorations can be provided within a single golf ball such that one color change occurs at a first temperature with a second color change occurring at a second temperature. By selecting appropriately contrasting and compatible colors, one can provide a golf ball which undergoes an initial color change at about 20° C. and which further undergoes a second color change at about 10° C. In such an embodiment, the golfer receives a visible early indication of a dropping temperature of the golf ball. The second temperature change indicates that ball temperature has dropped sufficiently that performance of the ball may be impaired.

With respect to golf balls having a single color change point, it has been found useful to indicate a color change point within a range of about 10° C. to about 20° C. For example, if a color change point of 10° C. is selected, the thermochromic dyes I–IV are colorless at higher than the color change point, but show their own characteristic colors when they are cooled to lower than 10° C. At a temperature lower than 10° C., that is, a white golf ball appears in a black color when it is coated with the thermochromic dye I, in a red color when with the thermochromic dye II, in a blue color when with the thermochromic dye III, and in an orange color when with the thermochromic dye IV. On the other hand, when they are warmed to a temperature higher than 10° C., the golf balls with characteristic colors turn white as the thermochromic dyes become colorless. Accordingly, the golf balls of the present invention reversibly change their colors with temperature.

Figure 2:
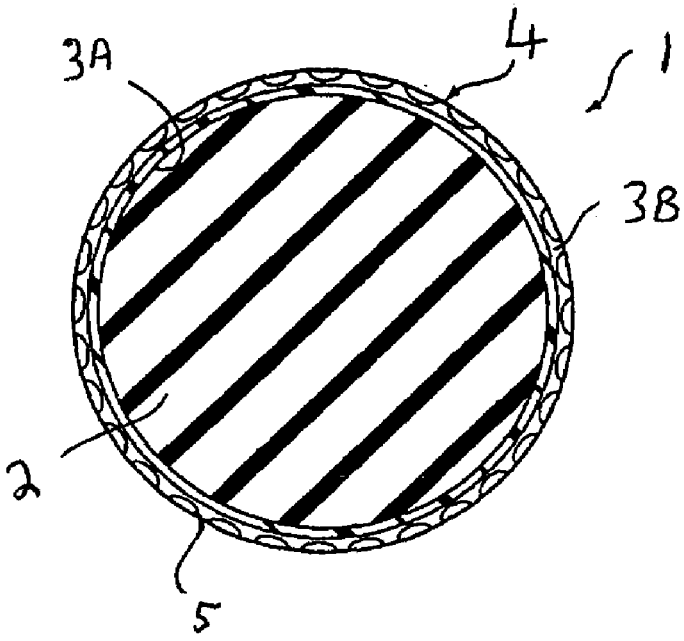
FIG. 2 is a cross-sectional view showing the structure of a multi-piece golf ball in according with an embodiment of the present invention.

The golf balls of the present invention can be manufactured by any number of conventional methods. With reference to FIG. 1, there is shown the structure of a thermochromic 2-piece golf ball 1 according to an embodiment of the present invention. As shown in FIG. 1, the thermochromic 2-piece golf ball has a structure consisting of a core 2 and a cover 3 coated with a transparent coating 4 such as a primer and/or clear top coat layer(s). The core 2 is made of a synthetic rubber of high resilience. Onto the core 2, the cover 3 is molded from an ionomer resin (e.g., sold under the trade name of Surlyn™ from DuPont U.S.A.) by a well-known technique, such as injection molding. After being provided with dimples 5, the cover 3 is coated with the transparent coatings by, for example, spraying. As seen in FIG. 2, a 3-piece golf ball may be comprised of an inner cover layer 3A and an outer cover layer 3B instead of the cover 3. Suitable ionomer resins and techniques for constructing a cover 3 for a 2-piece ball may be found in reference to U.S. Pat. No. 6,130,294 which is incorporated herein by reference.

In accordance with the present invention, a thermochromic compound may be contained in the cover 3 (the outer cover layer for 3-piece golf ball) or in one of the transparent materials which may form the coating 4 on the cover. In this regard, together with additives such as dispersants, the thermochromic compound is homogeneously mixed with an ionomer resin and the mixture is, for example, injection-molded at a uniform thickness on the core 2 to form the cover 3. As mentioned above, if the golf ball has a three- or more multi-piece structure, the thermochromic compound is preferably contained in the outer cover layer. Alternatively, the thermochromic compound may be uniformly mixed with the transparent coating 4 and then coated on the cover 3 by a conventional technique such as spraying. Suitable multi-piece golf ball covers, techniques, and formulations may be found in reference to U.S. Pat. No. 6,037,419 and which is incorporated herein by reference.

Such teachings may be modified in accordance with the present invention such that the cover 3 or the transparent coating 4 comprises a thermochromic compound in the amount of about 0.1 to about 10.0 parts per hundred or more of the respective cover composition or transparent top coat composition.

EXAMPLES

Preparation of Core Ball

A conventional synthetic rubber composition used in Assignee's commercially available FANTOM Power Distance™ golf ball was vulcanized at around 160° C. for 10 minutes in a typical mold to prepare a core ball for 2-piece golf ball which measured 38.4 mm in diameter.

Formation of Cover

A typical cover resin composition comprising a mixture of Surlyn™ ionomer 8940 in a 50:50 ratio with Surlyn™ ionomer 9910 was mixed with thermochromic compounds and additives as shown in Table 1, below, and the resulting mixtures were molded into covers with a thickness of 2.3 mm onto the core by injection. The ionomer 9910 is a clear ionomer which provides for a transparent cover. If desired, a cover made out of 100% 9910 ionomer may be used. When the 9910 is mixed with an 8940 ionomer, the cover is no longer transparent but remains translucent and provides for the color change pigment to be visualized. As is readily appreciated, when the thermochromic pigments are to be added into the ionomer, the ionomer mix should not have titanium dioxide or other pigments present which may mask the visibility of the thermochromic pigments. After the formation of dimples on the covers, a conventional transparent top coating such as a primer layer and/or a polyurethane clear top coat composition was applied to the covers. The values in the tables below are expressed in parts per hundred (PPH) relative to the total constituents of the respective cover formulation or transparent coating formulation.

TABLE 1

| | Examples | | | |
|---|---|---|---|---|
| Ingredients | 1 | 2 | 3 | 4 |
| Cover Resin Composition | 100 | 100 | 100 | 100 |
| Thermochromic Cpds.[1] | 0.1 | 3 | 5 | — |
| Additives | 1 | 1 | 1 | 1 |

Note.
[1]Example 1: Thermochromic dye I
Example 2: Thermochromic dye II
Example 3: Thermochromic dye III

Formation of Transparent Coat

On the cover prepared with the composition of Example 4 of Table 1 (containing no thermochromic dye), thermochromic transparent top coat compositions as set forth in Table 2 were applied. The thermochromic containing top coat layers were applied having a thickness of about 0.2 mm. Suitable polyurethane coatings, additives, and application techniques are well known in the art as represented by U.S. Pat. No. 5,785,612 and which is incorporated herein by reference.

TABLE 2

| | Examples | | | |
|---|---|---|---|---|
| Ingredients | 5 | 6 | 7 | 8 |
| Polyurethane resin composition | 100 | 100 | 100 | 100 |

TABLE 2-continued

| Ingredients | Examples 5 | 6 | 7 | 8 |
|---|---|---|---|---|
| Thermochromic Dyes[1] | 0.1 | 3 | 5 | — |
| Additives | 2 | 2 | 2 | 2 |

Note
[1]Ex. 5: Thermochromic dye IV
Ex. 6: Thermochromic dye IV
Ex. 7: Thermochromic dye IV

Color Observation

The golf balls manufactured according to Examples 1 through 8 were observed for color change and the results are given in Table 3, below.

TABLE 3

| Golf Balls | Lower Temp. | Thermochromic Point | Higher Temp. |
|---|---|---|---|
| Example 1 | Black | 10° C. | White |
| Example 2 | Red | 10° C. | White |
| Example 3 | Blue | 10° C. | White |
| Examples 5–7 | Orange | 10° C. | White |

Test for Strength

1. Method: Golf balls (Example 3 and Comparative Example 2) were repetitively jetted through a one-meter long pipe into a disk 10 cm in diameter (10° loft, groove formed as in iron club) by use of an air pressure of 0.75 kgf/cm$^2$. The durability of the golf balls was expressed as a hit number until the golf balls were broken.

2. Result

TABLE 4

| Golf Balls | Hit No. |
|---|---|
| Comparative Ex. 2 (general 2PC) | 130 |
| Example 4 | 130 |

Note:
Measured with a durability tester

3. Analysis

As set forth in the comparative examples and test data in the above tables, performance data of a control ball, labeled FANTOM Power Distance™, compared to the various thermochromic pigmented balls is provided. In Tables 4 and 5, sample balls having 1 PPH of the photochromic pigment in the ionomer cover composition were evaluated. The sample balls having a 2-piece construction were subjected to the durability test as described above along with the performance test data as set forth in Table 5. As indicated the performance of the balls with respect to performance characteristics and durability was unaffected by inclusion of the thermochromic pigment into the ionomer cover. While not separately reported, no deterioration of performance results have been observed in balls having the thermochromic pigment added to the transparent polyurethane top coat.

On the surface of the golf ball comprising a thermochromic compound-dispersed within either the cover or the transparent exterior ball coating, the colors which reversibly change with each other can be physically marked, together with the thermochromic temperature. For example, the expression "Red↓10↑White" may be printed on the thermochromic golf ball which shows a red color at lower than 10° C. while appearing white at higher than 10° C. According to such a color identification, the playing companions can avoid using golf balls of the same color. One set of three thermochromic golf balls which are different in color from each other can be packed in a box. In this case, one or two boxes per golfer are sufficient for the golfers to play golf balls of different colors.

As described hereinbefore, golf balls of the present invention can bring about various advantages in playing golf. Because the golf balls of the present invention express their body temperatures as characteristic colors, the golfers can warm the golf balls to the desired temperature, usually 10° C. or higher, during low-temperature play. Accordingly, the players' confidence is improved knowing that the ball is at a temperature which will perform well.

While the embodiments described above are directed to a uniform dispersion of the thermochromic pigments in the outer visible surface(s) of the golf ball, the thermochromic pigment may also be used in a localized manner with respect to a golf ball. For instance, using a pad printing technique, a localized region or pattern of the thermochromic pigments may be applied to a localized surface of a golf ball. The localized pigments may be in the form of a company logo,

TABLE 5

| Ball | Carry (Disp/Dist | Total (Disp/Dist) | Velocity (Ball/Head) | Launch Angle | Back Spin | Trajectory |
|---|---|---|---|---|---|---|
| FANTOM Power Distance (Control) | 5.89/202.33 | 9.63/210.83 | 130.75/91.25 | 11.83 | 2663.83 | 5.85 |
| S/D | 1.44 | 4.26 | 1.06/0.97 | 0.31 | 62.16 | 0.17 |
| Red | 6.17/201.68 | 8.42/212.01 | 130.25/90.8 | 11.88 | 2779.24 | 6.10 |
| S/D | 1.57 | 4.57 | 1.25/1.12 | 0.45 | 67.42 | 0.29 |
| Blue | 5.49/203.12 | 7.98/211.37 | 131.27/91.24 | 11.81 | 2771.29 | 5.94 |
| S/D | 1.94 | 3.76 | 1.02/1.24 | 0.11 | 89.75 | 0.37 |
| Violet | 6.24/200.97 | 8.94/210.47 | 131.75/91.57 | 11.82 | 2801.79 | 6.12 |
| S/D | 2.19 | 4.23 | 0.97/1.11 | 0.23 | 79.29 | 0.33 |
| Yellow | 5.92/201.49 | 8.24/211.12 | 132.01/91.92 | 11.86 | 2641.31 | 6.01 |
| S/D | 2.01 | 4.32 | 1.12/1.64 | 0.28 | 72.19 | 0.41 |

advertising, or warning indicia, such as an exclamation point or thermometer. In this manner, when the ball reaches a critical point temperature, the logo or insignia will appear. To the extent the insignia appears on multiple locations of the ball, such localized patterns would be visible without having to move the ball during play. In this manner, a traditional white golf ball may be provided which maintains the overall appearance of a white ball. In the described embodiment, only a portion of the ball's outer surface will undergo a color change.

Where the thermochromic pigments are added as part of a pad printing process, the pad printing inks may have the same effective amounts of thermochromic pigments added as either the cover compositions or the top coat compositions. In other words, between about 0.1 parts per hundred ink to about 5.0 parts per hundred ink is useful for achieving the desired color change.

Alternatively, the thermochromic pigment may be applied to either the cover or the transparent coatings as described above. Thereafter, a logo or other marking can be applied in a black ink outline in which a center portion is applied in white ink. In this manner, the portion of the ball surrounding the logo will undergo a color change while the white ink portion within or defining the logo provides a visible contrast which highlights the logo portion. The black ink applied as an outline or border, further accentuates the demarcation between the color change portion of the golf ball and the logo.

Further, use of the thermochromic pigments in either the outer cover, the transparent coatings, or in association with surface applied printing inks may also be used in combination with other types of color change balls. For instance, as described in assignee's co-pending application having attorney docket number FNT-10, entitled "Photochromic Golf Ball" and having an identical filing date as this application, it is possible to add pigments to one of an outer cover, a clear top coat, or a pad printing ink to bring about a pigment color change when the respective portion of the ball is exposed to ultraviolet radiation. Assignee's above referenced co-pending FNT-10 application is incorporated herein by reference. A golf ball can be constructed which has a combination of the photochromic properties of assignee's photochromic patent application referenced above along with additional thermochromic pigments as described herein. In this manner, it is possible to have a golf ball which changes color upon exposure to U.V. radiation while a second color change, such as on a pad printed indicia may occur when a temperature of the ball reaches a predetermined critical point. Accordingly, it is with the aspect of the present invention that various aspects of the embodiments of a thermochromic ball and a photochromic ball may be combined to produce a golf ball having one or more selected properties of each type of described ball.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of the various embodiments may be interchanged, both in whole or in part. Therefore, the spirit and scope of the appended claims should not be limited to the description of the preferred versions contained therein.

What is claimed is:

1. A thermochromic golf ball having a thermochromic pigment contained in a polyurethane top coat finish, the thermochromic pigment comprises a heat sensitive microcapsule having a core material surrounded by a melamine wall material, said core material comprising a dye responsible for a color change and a wax for dispersing the dye, where the golf ball reversibly changes color between two different color states according to temperature.

2. The thermochromic golf ball as defined in claim 1, wherein the thermochromic golf ball is white when it is above a critical point temperature and said top coat finish changes color when the ball is at or below said critical point temperature.

3. The thermochromic golf ball as defined in claim 1, wherein the dye is selected from the group consisting of dibutylamino-6-methyl-7-anilinofluoran; 3,3-diethylamino-7-chlorofluoroan; crystal violet lactone; 3-cyclohexyl amino-6-chlorofluoran; and combinations thereof.

4. The thermochromic golf ball as defined in claim 1, wherein the wax is selected from the group consisting of myristyl alcohol, cetyl alcohol, stearyl alcohol and mixtures thereof.

5. The thermochromic golf ball as defined in claim 1 wherein the thermochromic compound is contained in the amount of 0.1–10.0 parts per hundred relative to said top coat finish.

6. The thermochromic golf ball as defined in claim 1, wherein the thermochromic compound is present in an amount of about 0.1 to about 10.0 parts per hundred of said top coat finish.

7. A golf ball comprising:

a core;

an outer cover surrounding said core, said outer cover defining a plurality of dimples;

a clear polyurethane top coat applied to an exterior surface of said outer cover;

a thermochromic pigment comprising a heat-sensitive microcapsule having a core material surrounded by a melamine wall material, said core material comprising a dye responsible for a color change and a wax for dispersing the dye, the thermochromic pigment undergoing a color change when lowered to a critical point temperature, said thermochromic pigment being present in said clear polyurethane top coat layer;

wherein, when the golf ball temperature is lowered to or below said critical point temperature, the golf ball undergoes a reversible color change.

8. The golf ball according to claim 7 wherein said photochromic pigment is selected from the group consisting of dibutylamino-6-methyl-7-anilinofluoran; 3,3-diethylamino-7-chlorofluoroan; crystal violet lactone; 3-cyclohexyl amino-6-chlorofluoran; and combinations thereof.

9. The golf ball according to claim 7 wherein when said thermochromic pigment is present in said clear polyurethane top coat, said thermochromic pigment has a concentration of 0.1 parts per hundred to about 10.0 parts per hundred of the clear polyurethane top coat composition.

10. The golf ball according to claim 7 wherein said golf ball further defines a thermochromic insignia printed on a surface of said golf ball, said insignia having increased visibility when said clear polyurethane top coat of said golf ball reaches a critical point temperature.

* * * * *